US005465459A

United States Patent [19]

Hopkins

[11] Patent Number: 5,465,459

[45] Date of Patent: Nov. 14, 1995

[54] STAIRWAY CARPET FASTENING DEVICE

[76] Inventor: David M. Hopkins, 150 Toland St., Unit #1, San Francisco, Calif. 94124

[21] Appl. No.: 188,502

[22] Filed: Jan. 28, 1994

Related U.S. Application Data

[63] Continuation-in-part of Ser. No. 980,366, Nov. 23, 1992, abandoned.

[51] Int. Cl.[6] ..... A47G 27/04

[52] U.S. Cl. ..... 16/11; 16/10

[58] Field of Search ..... 16/4, 9–11, 16, 16/17

[56] References Cited

U.S. PATENT DOCUMENTS

| | | | |
|---|---|---|---|
| 1,836,375 | 12/1931 | Kernochan | 16/10 |
| 2,750,621 | 6/1956 | White | 16/10 |
| 2,958,895 | 11/1960 | Sarkissian | 16/10 |
| 3,551,939 | 1/1971 | Rager | 16/10 |
| 3,559,273 | 2/1971 | Porzio | 16/16 |
| 4,309,805 | 1/1982 | Jacobson | 29/429 |

FOREIGN PATENT DOCUMENTS

| | | | |
|---|---|---|---|
| 451231 | 7/1936 | United Kingdom | 16/16 |
| 1363806 | 8/1974 | United Kingdom | 16/6 |

*Primary Examiner*—Lowell A. Larson
*Assistant Examiner*—Donald M. Gurley

[57] ABSTRACT

A device for fastening carpet covering to stairways. A prefabricated strip fastener of plastic or similar material preformed or capable of being formed in the field to have two legs and fixedly positioned on its legs, tackless holding pins for carpets and adapted for automatic stapling or nailing into the crotch of a stairway for receiving the carpet covering.

9 Claims, 2 Drawing Sheets

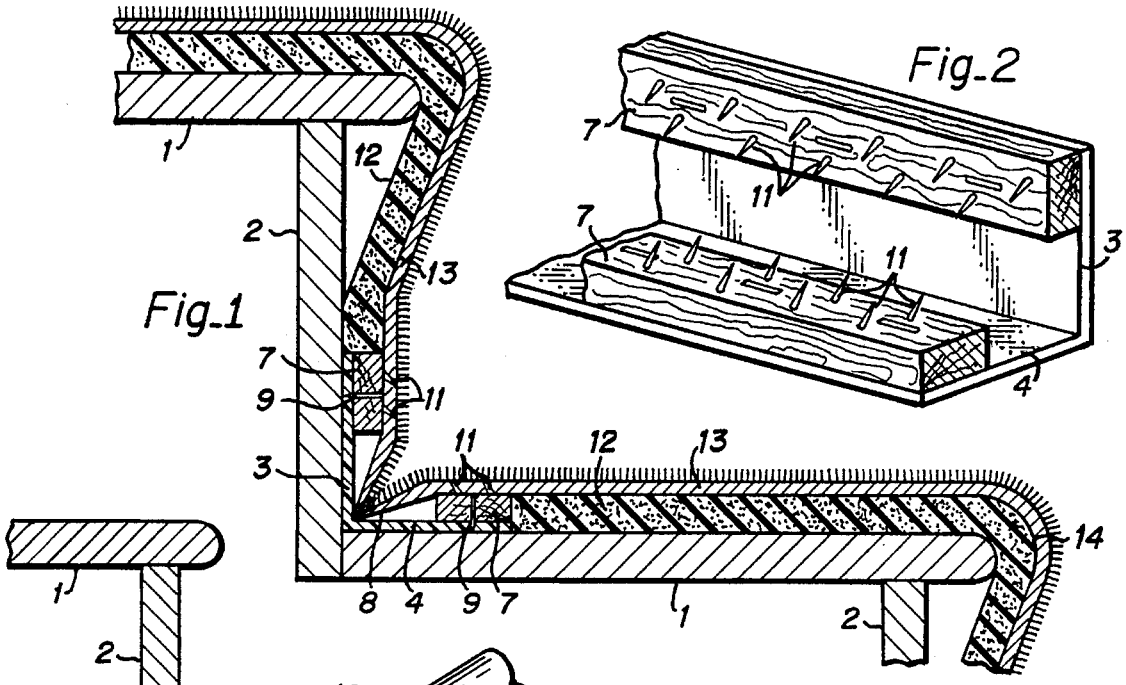
Fig_1
1
2
3
4
7
8
9
11
12
13
14
Fig_2
3
4
7
11
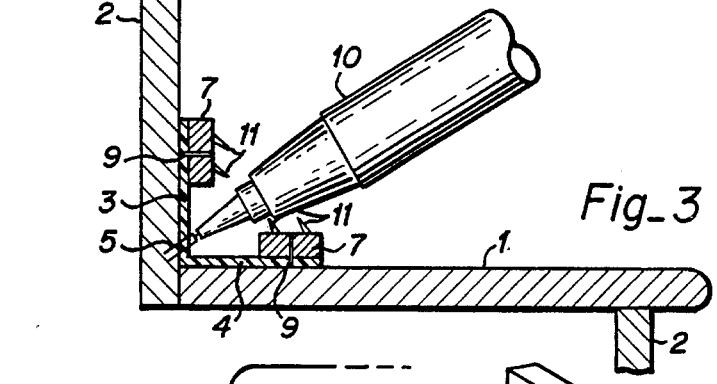
Fig_3
1
2
3
4
5
7
9
10
11
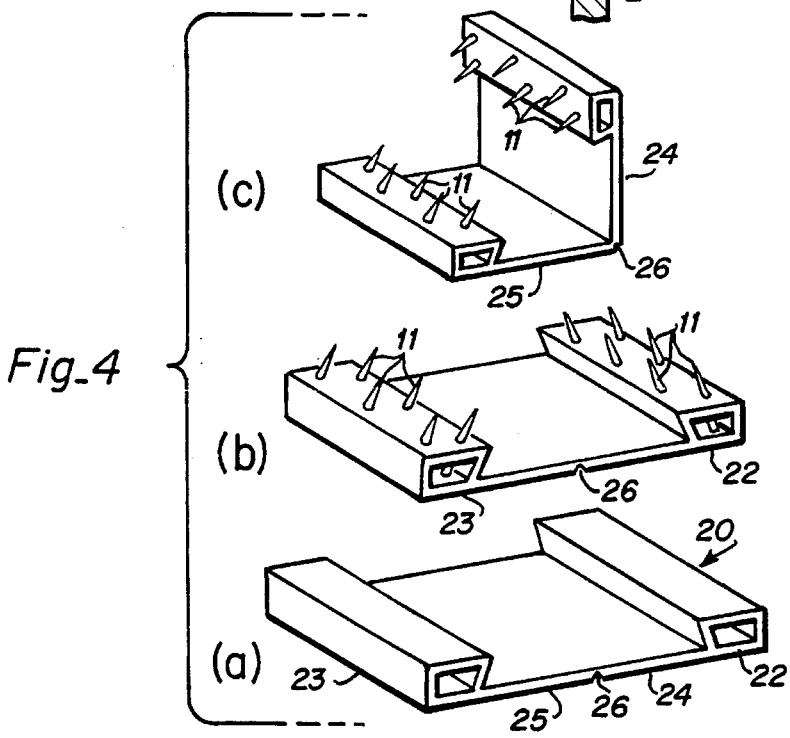
Fig_4
(a)
(b)
(c)
20
22
23
24
25
26
11

STAIRWAY CARPET FASTENING DEVICE

CROSS REFERENCE TO RELATED APPLICATIONS

This application is a continuation-in-part of Ser. No. 07/980,366 filed Nov. 23, 1992, now abandoned, for Device and Method for Fastening Carpeting to Wooden Stairways.

FIELD

This application relates to a carpet fastening or anchoring device. More particularly this application relates to a carpet fastening device including vertical and horizontal portions having angularly disposed carpet securing pins attached to the inside face of the outer edges of the vertical and horizontal portions for engaging with and anchoring the carpet covering stair treads and risers.

BACKGROUND

The art of laying carpets on the floors of buildings has for many years been accompanied by a considerable amount of tedious and costly labor. This is particularly true of the covering of stairways where a tight fit against the tread and riser is necessary. Basically it is required to maintain a tension of the carpet against the supporting structure while nailing in the holding carpet tacks.

Over the years so-called "tackless fasteners" have been developed in which pointed spikes or pins are pre-embedded in strips which are in turn fastened to the floors or other supporting structures. The carpet is then, while still under tension, hooked over the protruding spikes and thus held in position.

Related art which has been addressed to the problem is listed below:

Sarkissian (U.S. Pat. No. 2,958,895) teaches a specially shaped device requiring substantial labor of construction and installation and does not provide adequate fastening.

White (U.S. Pat. No. 2,750,621) utilizes an elaborate and cumbersome metal plate of complex construction and doubtful effectiveness in holding the carpet.

Rager (U.S. Pat. No. 3,551,939) is simpler but is applicable to metal or concrete stairways and still involves excessive labor of installation.

Particularly troublesome and time consuming is the practice of attaching fastening strips to the risers of the stairways which is awkward and requires the installer to almost stand on his head to apply.

Other complex devices and methods are set forth in reference in Form PTO 1449 accompanying herewith.

THE INVENTION

OBJECTS

It is a principal object of the present invention to provide a novel carpet anchoring device for stairways which overcomes the limitations of the prior art, including the relatively complex manufacture o such devices, their bulkiness as related to packaging and shipping, and the tediousness associated with installation of such devices on stairway treads and risers.

It is another object of my invention to produce a stairway carpet anchoring device which accommodates the muzzle of industrial stapling guns and automatic nailers.

It is further an object of my invention to provide a stairway carpet anchoring device of simplified construction and which may be stored and shipped flat, and easily folded at the point of use to form vertical and horizontal portions suitable for engaging and anchoring carpets on the treads and risers of stairways.

It is yet another object of my invention to produce a stairway anchoring device having outer portions of a coordinate thickness with various underlying pad thicknesses.

Other and further objects of the present invention will become evident from the following written description, drawing, and claims appended hereto.

DRAWINGS

FIG. 1 is a cross-section of a stairway showing carpet as installed using the fastening device of my invention.

FIG. 2 is a perspective view of my right-angular strip or base fastening device .

FIG. 3 shows the method of installing the device of the present invention to a stair.

FIGS. 4(*a–c*) show preferred embodiments of carpet fastening devices of unitary construction.

SUMMARY

Figure 5:
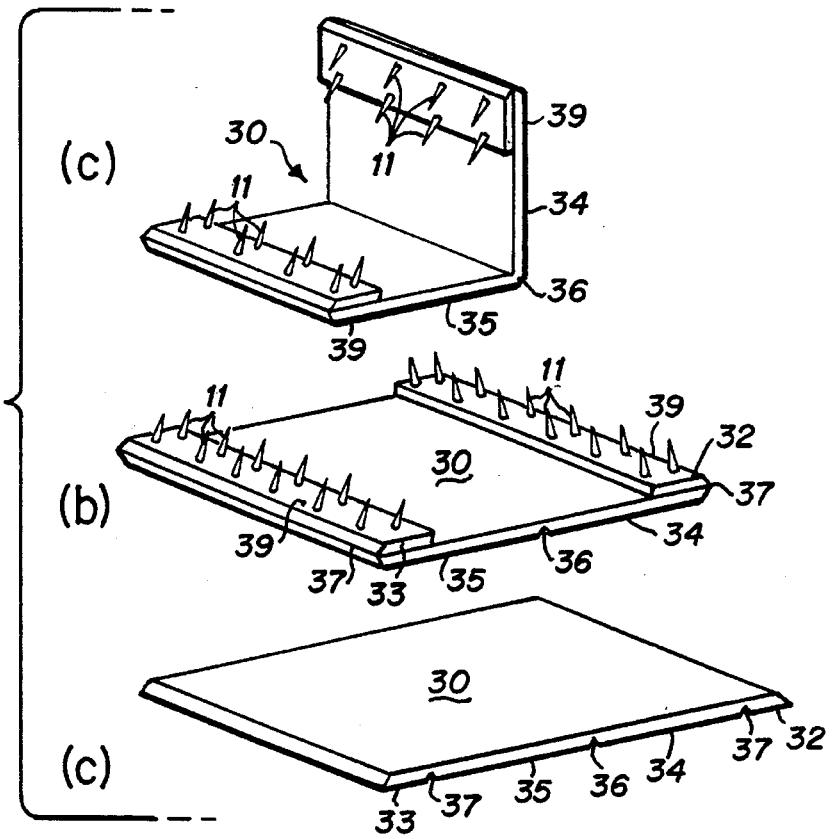
FIGS. 5(*a–c*) show alternate preferred embodiments of carpet fastening devices of unitary construction capable of manufacture from flat sheet stock.

I have invented a relatively simple device and method for readily securing the holding spikes or tackless fasteners to the stairway which is simple of manufacture, easy of application and reliable of performance. It saves a great deal of labor in installing carpets on stairways over previous methods and is more effective.

Basically it comprises either a right-angular or flat strip or base member fabricated preferably of a plastic material. I employ the aforementioned "tackless fasteners" which are embedded in the interior with the angular spikes or holding pins, typically made of steel or some other metal, into preliminary strips. The latter are in turn stapled to the outstanding legs of the aforementioned legs of the right-angular strips or bases. The latter are in turn stapled to the crotch of the stairway close to the base of the riser. This is a rapid operation and places the spiked pins or fasteners in ready position to receive the carpet.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

Referring to the figures there is seen at FIG. 1 a wooden stairway tread 1 and riser 2. The vertical leg of my right angular fastening device or base member which I prefer to fabricate from a plastic such as polyethylene, is seen at 3 . The horizontal leg is seen at 4 integrally joined to the vertical leg and forming a crotch therebetween at the bend line. To these legs there are shown stapled the preliminary backing strips 7 by means of staples 9. The spacing of the inside edge of the backing strip to the bend, crease or crotch in the base member is of sufficient length to allow a staple gun or the muzzle of an automatic nailing gun to be used in securing the device to the stairway crotch.

Inclined pointed holding spikes or pins, typically made from steel or other metal, are shown at 11 imbedded in strips 7. These protrude sufficiently to engage carpet 13 and are inclined toward the stairway crotch 8.

The device 4 of FIG. 2 is shown stapled upon the vertical leg 3 to riser 2 by means of staple 5 near the crotch of the device and close to the stairway crotch 8. This I accomplish by the use of a commercially available electric staple gun 10 as shown schematically on FIG.3. For this purpose I may use 9/16" steel staples as required by the width and thickness of the carpet. Alternately, a nail gun may be used, particularly on concrete stairs where a concrete nail gun may be required, to secure the carpet fastening device to the crotch of the stair.

After my base member or right-angular strip fastening device of FIG.2 is stapled or nailed in position as shown on FIG.3 I may proceed to install the padding 12 if required and then the carpet 13, feeding it over the tread 1 and riser 2 while engaging the spikes 11 of strips 7. Engagement of the spikes and insertion into the crotch 8 is aided by the use of commercially available stretching and hooking tools well known in the art of carpet laying.

My right-angular strip fastening device or base member is prefabricated and I prefer to use polyethylene for this. It may be cut rapidly to the length required depending on the width of the stair by means of pruning shears or what are known as "aviation snips" in the trade. Since the stapling of my device into position is also a rapid operation it is evident that my method using my device is highly saving in labor.

In actual practice I have attained a labor saving of over 50%. I have attained also greater flexibility in the installation of stairway carpeting and more satisfactory retention of the carpeting in position by the use of my device and method.

In another series of embodiments, the vertical leg 3, the horizontal leg 4, and the backing strips 7 are constructed as a single piece, preferably by extrusion, to which the pointed holding spikes or pins are later incorporated therein. This reduces the number of parts required to produce the device and significantly simplifies the construction of the device.

A preferred embodiment of the carpet fastening device of single-piece construction is shown in FIG. 4. FIG. 4(*a*) shows the device as a flat, one-piece elongated base member 20, preferable formed by extrusion and preferably of plastic, although any stiff yet flexible material will work. The edges 22 and 23 are thicker than the inner portions 24 and 25 and may be either solid or preferably have a hollow portion therein, as shown in FIG. 4(*a*), so as to conserve materials or to facilitate cutting. A plurality of pointed holding spikes or pins 11 (preferably steel or some other metal) are permanently and securely inserted and embedded into the thicker edge pieces 22 and 23 so that the pointed ends protrude upwards and away from these edges, and are angled towards the center longitudinal axis of the extrusion 20. The thicker edges ensure that the moment exerted on the pointed spikes 11, upon engaging the tension of the stretched burlap of the carpet, will encounter a sufficient counter-moment so that the pointed spikes will not loosen from the edges of the extrusion 20.

FIG. 4(*b*) shows the embodiment with the pointed spikes or pins 11 inserted in to the thicker edge portions 22 and 23. The flat configuration of the device as shown in FIG. 4(*b*) makes the device easy to cut to predetermined lengths, package and ship as the device may be easily stacked and inserted into a box or container with a minimum of wasted space.

Use of the device requires that the carpet installer merely bend the extrusion of FIG. 4(*b*) so that it achieves the configuration of FIG. 4(*c*). Folding groove 26, located on and running the length of the longitudinal centerline on the back-side of the extrusion permits the extrusion to fold easily along this line upon application of bending pressure. As can be seen in FIG. 4(*c*), inner portion 24 is now the vertical leg, and inner portion 25 is the horizontal leg of the device as bent, forming a crotch therebetween. The spacing of the inner portion 24 (or vertical leg) and the inner portion 25 (horizontal leg) is such that a commercial stapling gun or a nail gun may be used to fasten the device to a wooden stair. For concrete stairs, the spacing between the vertical and horizontal portions will allow the use of a concrete nail gun, or alternately, a glue may be used to secure the device to the concrete riser and tread. Installation onto a stairway requires that the bend be inserted into the crotch of the stair as formed by the junction of the riser with the tread, and the device secured by the fastening means described above.

Further, as the base material is easily cut, the horizontal leg portion may be kerfed to allow installation on curved risers.

This embodiment contains fewer elements and is of simpler construction than the embodiment of FIG. 3, containing only the single extrusion and the pointed holding spikes, whereas the FIG. 3 embodiment contains the angular base member, two edge backing strips, means for holding the backing strips to the base member, and the pointed holding spikes.

FIG. 5 shows an alternate preferred embodiment of a stairway carpet fastening device. As seen in FIG. 5(*a*), the single-piece elongated base member 30 is of uniform thickness (unlike the previous embodiment with the thicker, either solid or hollow, edge portions) and is preferably formed by extrusion of any stiff, yet flexible material, such as plastic, aluminum or tin. Three grooves, one center folding groove 36 along the longitudinal center of the extrusion and two edge grooves 37, one on either side of the center folding groove, facilitate the folding and bending of the extrusion. The edge grooves are spaced such that when the edges 33 are folded along the edge grooves 37 back towards the center of the device, double thickness edge portions 39 are formed. A plurality of pointed holding spikes or pins 11 are permanently and securely inserted into the double thickness edge portions 39 so that the pointed ends protrude upwards and away from these edges, and are angled towards the center longitudinal axis of the extrusion 30. The double thickness edges ensure that the moment exerted on the pointed spikes 11, upon engaging the burlap of the carpet, will encounter a sufficient counter-moment so that the pointed spikes will not loosen from the edges of the extrusion 30.

FIG. 5(*b*) shows the embodiment with the pointed spikes or pins 11 inserted into the double thickness edge portions 39. The flat configuration of the device as shown in FIG. 5(*b*) makes the device easy to package and ship as the device may be easily stacked and inserted into a box or container with a minimum of wasted space. The base member is cut to predetermined lengths prior to packaging and shipping.

Use of the device requires that the carpet installer merely bend the elongated base member of FIG. 5(*b*) so that it achieves the configuration of FIG. 5(*c*). Folding groove 36, located on and running the length of the longitudinal centerline on the back-side of the extrusion permits the extrusion to bend easily along this line upon application of bending pressure. As can be seen in FIG. 5*c*, after bending is complete, inner portion 34 is now the vertical leg, and inner portion 35 is the horizontal leg of the device as bent, having a crotch therebetween. The spacing of the inner portion 34 (or vertical leg) and the inner portion 35 (horizontal leg) is such that a commercial stapling gun or nail gun may be used to fasten the device to a wooden stair. For concrete stairs, the spacing between the vertical and horizontal portions will allow the use of a concrete nail gun, or alternately, a glue may be used to secure the device to the concrete riser and tread. Installation onto a stairway requires that the bend be inserted into the crotch of the stair as formed by the junction of the riser with the tread, and a the device secured by the fastening means described above.

As in the previous embodiment, curved risers may be accommodated by kerfing the horizontal leg portion of the carpet fastening device.

This embodiment contains fewer elements and is of simpler construction than the embodiment of FIG. 3, containing only the single extrusion and the pointed holding spikes, whereas the FIG. 3 embodiment contains the angular base member, two edge backing strips, means for holding the backing strips to the base member, and the pointed holding spikes. Further, as the extrusion 30 contains no additional features other than the three grooves, it is simpler than the previous embodiment as shown in FIG. 4 and standard plastic or aluminum sheet stock may be used for the extrusion. The grooves may be scored or scribed, for example, as part of the manufacturing process, rather than being part of the extrusion.

Figure 6:
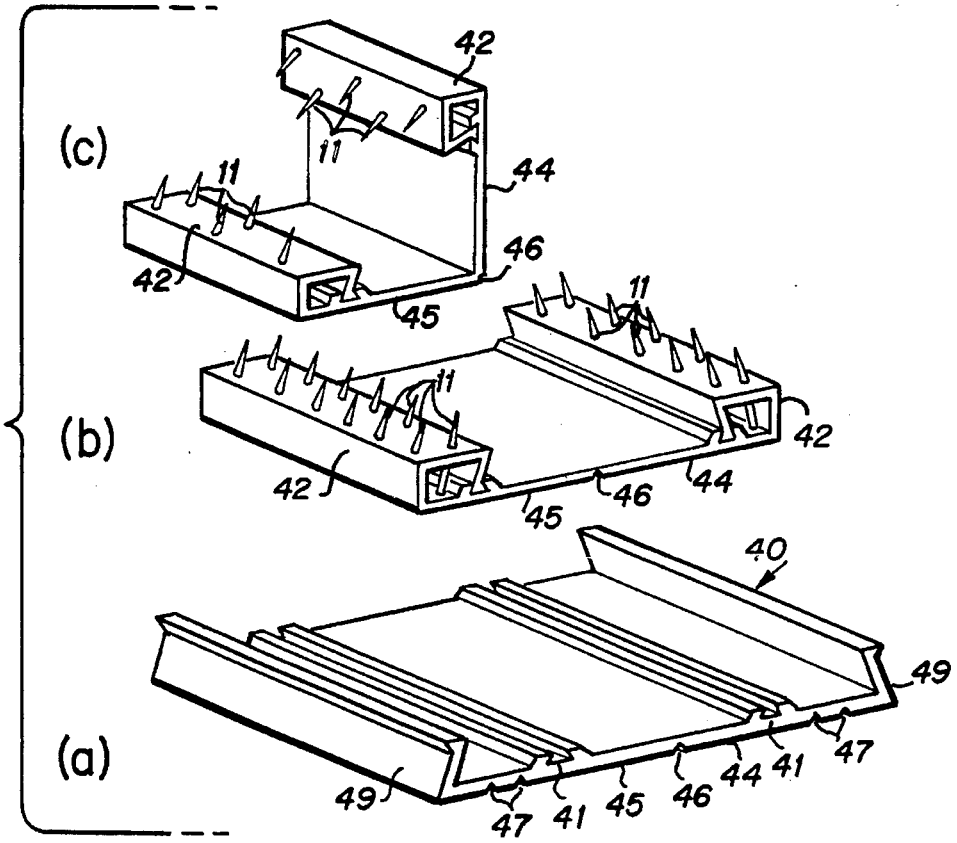
FIGS. 6(*a–c*) show third embodiments of carpet fastening devices of unitary construction which provide for consideration of various thicknesses of underlying pad.

In the embodiment of FIG. 6, the single-piece elongated base member 40 has upwardly extending edge flaps 49, with the flap terminating in a flared edge. The edge flaps are bent inward along the edge folding grooves 47 towards the inner portion of the extrusion 40. The flared edges of the flaps are permanently inserted into the receiving locking grooves 41 to form a hollow tubular edge portion 42. See FIG. 6(*c*). A plurality of pointed holding spikes or pins 11 are permanently and securely inserted into the tubular edge portions 42 so that the pointed ends protrude upwards and away from these edges, and are angled towards the center longitudinal axis of the extrusion 40. The thicker edges ensure that the moment exerted on the pointed spikes 11, upon engaging the tension of the stretched burlap of the carpet will encounter a sufficient counter-moment so that the pointed spikes will not loosen from the edges of the extrusion 40.

A novel feature of this embodiment is that the edge folding grooves 47 may be spaced so as to provide a tubular edge section of various thicknesses so as to coordinate with a variety of underlying pad thicknesses. This feature would allow a smooth transition from the underlying pad to the carpet fastening device thus providing a more aesthetically pleasing carpet installation.

FIG. 6(*b*) shows the embodiment with the pointed spikes or pins 11 inserted into the tubular edge portions 42. The flat configuration of the device as shown in FIG. 6(*b*) makes the device easy to package and ship as the device may be easily stacked and inserted into a box or container with a minimum of wasted space. The device is cut to predetermined lengths prior to packaging and shipping.

Use of the device requires that the carpet installer merely bend the extrusion of FIG. 6(*b*) so that it achieves the configuration of FIG. 6(*c*). Folding groove 46, located on and running the length of the longitudinal centerline on the back-side of the extrusion permits the base member to bend easily along this line upon application of bending pressure. As can be seen in FIG. 6(*c*), inner portion 44 is now the vertical leg, and inner portion 45 is the horizontal leg of the device as bent forming a crotch therebetween. The spacing of the inner portion 44 (or vertical leg) and the inner portion 45 (horizontal leg) is such that a commercial stapling gun or nail gun may be used to fasten the device to a wooden stair. For concrete stairs, the spacing between the vertical and horizontal portions will allow the use of a concrete nail gun, or alternately, a glue may be used to secure the device to the concrete riser and tread. Installation onto a stairway requires that the bend be inserted into the crotch of the stair as formed by the junction of the riser with the tread, and a the device secured by the fastening means described above.

This embodiment contains fewer elements and is of simpler construction than the embodiment of FIG. 3, containing only the single extrusion and the pointed holding spikes, whereas the FIG. 3 embodiment contains the angular base member, two edge backing strips, means for holding the backing strips to the base member, and the pointed holding spikes. Further, this embodiment provides added flexibility in providing a stairway carpet fastening device of various edge thicknesses.

It should be understood that various modifications within the scope of this invention can be made by one of ordinary skill in the art without departing from the spirit thereof. I therefore wish my invention to be defined by the scope of the appended claims as broadly as the prior art will permit, and in view of the specification if need be.

I claim:

1. A carpet fastening device foldable by a user to a right angle shape for use in carpeting a stairway having vertical risers and horizontal treads forming a crotch therebetween comprising:

(a) an elongated base member of single piece construction having a top surface, a bottom surface, and a first edge region and a second edge region positioned substantially parallel to each other and to an inner region between said first and second regions, said first edge region and said second edge region having a thickness greater than said inner region, and said elongated base member having a longitudinal center line and having a groove formed therein coincident with the longitudinal centerline thereof, said groove for facilitating said base member to be folded along said groove; and (b) a plurality of pointed holding spikes embedded in said first edge region and said second edge region, said spikes protruding away from said top surface and being inclined towards said inner region in said base member;

whereby a user can fold said base member at said groove to form an L shaped member having a first leg and a second leg, said legs positioned substantially orthogonal to each other, and forming a crotch where said first leg meets said second leg, and whereby a user can use a staple gun or nail gun to secure said L shaped member to said crotch of said stairway.

2. A carpet fastening device as in claim 1 wherein said base member is formed by extrusion.

3. A carpet fastening device as in claim 2 wherein said base member is made of plastic.

4. A carpet fastening device as in claim 3 wherein said first edge region and said second edge region are hollow.

5. A carpet fastening device as in claim 3 wherein said first edge region and said second edge region are solid.

6. A carpet fastening device foldable by a user to a right angle shape for use in carpeting a stairway having vertical risers and horizontal treads forming a crotch therebetween comprising:

(a) an elongated base member having a top surface, a bottom surface, a first edge region and a second edge region positioned substantially parallel to each other and to an inner region between said first and second region, said first edge region and said second edge region having the form of said base member folded over on itself and towards said inner region, said first edge region and said second edge region having double the thickness of said inner region, and said base member having a longitudinal center line and having a groove formed therein coincident with the longitudinal centerline thereof, and (b) a plurality of pointed holding spikes embedded in said first edge region and said second edge region, said spikes protruding away from said top surface and being inclined toward said inner region in said base member;

whereby a user can fold said base member at said groove to form an L shaped member having a first leg and a second leg, said legs positioned substantially orthogonal to each other, and forming a crotch where said first leg meets said second leg, and whereby a user can use a staple gun or nail gun to secure said L shaped member to said crotch of said stairway.

7. A carpet fastening device as in claim 6 wherein said base member is formed by extrusion.

8. A carpet fastening device as in claim 7 wherein said base member is made of plastic.

9. A carpet fastening device for use in carpeting a stairway having vertical risers and horizontal treads forming a crotch therebetween comprising:

(a) an L shaped member of right-angular cross section characterized by a first vertical leg and a second horizontal leg, said legs forming a crotch therebetween, said first vertical leg having a first edge region and said second horizontal leg having a second edge region, said first edge region and said second edge region positioned substantially parallel to each other and to an inner region containing said crotch between said first and second regions, and said first edge region having the form of said first leg folded over on itself and toward said inner region, and said second edge region having the form of said second leg folded over on itself and toward said inner region, said first edge region and said second edge region having double the thickness of said inner region; and (b) a plurality of pointed holding spikes embedded in said first edge region and said second edge region, said spikes protruding away from said first edge region and said second edge region, and inclined toward said inner region, said first edge region and said second edge region having sufficient spatial clearance therebetween to allow access by a staple gun or a nail gun for securing the device to the crotch of the stairway.

* * * * *